US006746351B1

(12) United States Patent
Goodman

(10) Patent No.: US 6,746,351 B1
(45) Date of Patent: Jun. 8, 2004

(54) PRACTICE BALL

(75) Inventor: Robert I. Goodman, 1064 Riverside Dr., Harrodsburg, KY (US) 40330

(73) Assignee: Robert I. Goodman, Harrodsburg, KY (US)

( * ) Notice: Subject to any disclaimer, the term of this patent is extended or adjusted under 35 U.S.C. 154(b) by 0 days.

(21) Appl. No.: 10/216,145

(22) Filed: Aug. 9, 2002

Related U.S. Application Data

(60) Provisional application No. 60/317,986, filed on Sep. 6, 2001.

(51) Int. Cl.[7] ..... A63B 39/00

(52) U.S. Cl. ..... 473/596; 473/612; 473/613

(58) Field of Search ..... 473/612, 613, 473/596, 597, 280, 281, 610, 569

(56) References Cited

U.S. PATENT DOCUMENTS

| | | | | | |
|---|---|---|---|---|---|
| 2,597,704 | A | | 5/1952 | Carlson | |
| 2,776,139 | A | | 1/1957 | Blamey, Jr. | |
| 3,908,993 | A | | 9/1975 | Gentiluomo | |
| 3,908,994 | A | | 9/1975 | Astrom | |
| 4,219,959 | A | * | 9/1980 | Fleischer | 473/569 |
| 4,257,598 | A | | 3/1981 | Massino | |
| 4,261,565 | A | | 4/1981 | Massino, Sr. | |
| 4,415,154 | A | | 11/1983 | Engelhardt | |
| 4,581,299 | A | * | 4/1986 | Jager | 473/612 |
| 4,874,169 | A | | 10/1989 | Litchfield | |
| 4,880,233 | A | | 11/1989 | Song | |
| 4,930,776 | A | | 6/1990 | Newcomb et al. | |
| 4,957,300 | A | * | 9/1990 | Storry | 473/569 |
| 5,033,743 | A | | 7/1991 | Wright | |
| 5,133,550 | A | | 7/1992 | Handy | |
| 5,158,284 | A | | 10/1992 | Vogl | |
| 5,280,906 | A | | 1/1994 | Vitale | |
| 5,460,368 | A | * | 10/1995 | Pearson | 473/613 |
| 5,480,143 | A | | 1/1996 | McMurry | |
| 5,630,763 | A | | 5/1997 | Li-Tsan | |
| 5,676,611 | A | * | 10/1997 | Foster et al. | 473/613 |
| 5,700,211 | A | | 12/1997 | Mackie | |
| 6,012,997 | A | | 1/2000 | Mason | |
| 6,220,980 | B1 | * | 4/2001 | Adler | 473/613 |

* cited by examiner

*Primary Examiner*—Steven Wong
(74) *Attorney, Agent, or Firm*—King & Schickli PLLC

(57) ABSTRACT

A ball is provided for use in training that collapses when hit or kicked and then resiliently reforms itself to its original shape, dissipating kinetic energy and allowing use of the ball in a restricted geographical area. In one aspect, the ball of the invention includes incisions extending substantially through a shell, which deform upon striking, such that the ball and collapses venting air and dissipating kinetic energy. In another aspect, the ball of the present invention includes incisions extending only partially through the outer shell, contributing to the deforming properties of the ball when struck.

6 Claims, 2 Drawing Sheets

PRACTICE BALL

This application claims the benefit of priority in U.S. Provisional Patent Application Serial No. 60/317,986 filed Sep. 6, 2001.

TECHNICAL FIELD

The present invention relates generally to the field of practice balls for sports. In particular, the present invention relates to a ball for use in training that collapses when hit or kicked and then reforms itself to its original shape or form, dissipating kinetic energy and allowing use of the ball in a restricted geographical area.

BACKGROUND OF THE INVENTION

Training athletes, especially young athletes in various ball sports, e.g., baseball, requires a practice ball that will aid in developing hand-eye and foot-eye coordination, as well as developing motor skills, muscle strength, correct form and proper technique while being safe and not intimidating. While a regulation size sport ball captures the feel and sound of hitting the ball, the weight and hardness of the ball may be impractical or undesirable when there are geographical limitations of the practice area such as indoors or in a limited outdoor space. In addition, because of the force often applied to the regulation sport ball, practice time may be disrupted by continuous retrieval of balls at a great distance. Using a regulation sport ball also increases the chances of injuring younger athletes, who may not yet have developed the necessary skills to avoid such injury because of the weight of the ball and the force created when throwing, catching, kicking, or batting the ball.

Accordingly, there is a need for a practice ball that is not as hard or heavy as a regulation ball, which when struck or kicked travels only a limited distance for practice in sports such as baseball, softball, football, golf, tennis, soccer, and the like.

There have been several attempts to provide suitable practice balls for young athletes. In particular, U.S. Pat. No. 6,012,997 to Mason discloses a compound ball designed with spherical outer and inner shells, dimensioned to provide spacing therebetween. The outer shell is formed of molded polymeric material with circular apertures spaced over its surface. The inner shell is a gas-filled sphere which provides mass and rebound upon being struck with, for example, a bat. The outer shell of the Mason ball includes apertures and/or raised dimpling to limit flight distance and range, or to otherwise alter performance.

The Mason ball suffers from the disadvantage that flight performance or distance is altered both prior to and after the ball is struck. For example, in teaching a young athlete to hit or kick a ball, it would be advantageous for the ball to perform substantially as a regulation ball when traveling to the athlete, but to exhibit limited flight after the athlete has hit or kicked the ball. Such a ball would advantageously allow training of the athlete with a ball which performed normally until the point where it is kicked or hit, but which travels only a limited distance after being hit or struck.

SUMMARY OF THE INVENTION

In accordance with the purposes of the present invention as described herein, a ball is provided which safely, accurately and economically enables a person to develop correct form and proper technique in sports such as baseball, softball, golf, tennis and soccer. The invention comprises a collapsible reforming ball that has aerodynamic qualities or regulation ball-simulative characteristics during flight, including a single outer shell designed to eliminate or reduce energy transfer upon being struck or upon striking an object, thereby significantly reducing ball flight. It will be appreciated that this feature allows a significant reduction in ball flight upon striking the ball of this invention. It should also be appreciated that should the ball inadvertently strike a user, the reduction of energy transfer from the ball to the user significantly reduces the risk of injury.

In one aspect, this invention provides a training ball that performs in a manner that is substantially identical to a regulation ball when thrown, but which absorbs enough energy upon being hit or kicked to travel only a modest distance and reforms to its original shape, ready for a new kick or hit.

Typically, the collapsing-reforming ball provided by the invention is formed of a highly resilient rubberized or other soft resilient material with rubber-like properties. The material may be selected from the group of materials including, but not limited to, natural and synthetic elastomers, natural rubber, butadiene, butyl rubber, polybutyldiene rubber, styrene butyl diene, and the like.

In an especially preferred embodiment, the invention provides a collapsing-reforming ball comprising a hollow, spherical shell. Incisions are placed thereon extending through at least a portion of the wall of the hollow spherical shell. The placement, position, length, shape, and number of these "collapsing incisions" allow the ball to collapse when hit by, e.g., a bat, club or foot. The collapse of the ball, coupled with venting or exhausting of air contained within the hollow interior of the ball, dissipates the kinetic energy generated by an object, for example a bat, striking the collapsing-reforming ball and prevents or reduces the transfer of the bat kinetic energy to the collapsing-reforming ball. Upon transference of the momentum (energy) of the bat, foot, etc., the ball of the invention absorbs and dissipates the energy, and the ball travels only a short distance. It will be appreciated that the resilient nature of the material comprising the ball allows reformation to its original shape, ready for another hit or kick.

Additional advantages and other novel features of the present invention will become apparent to those skilled in this art from the following description wherein there is shown and described a preferred embodiment of this invention, simply by way of illustration of the modes currently best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWING

The accompanying drawing incorporated in and forming a part of the specification illustrates several aspects of the present invention and, together with the description, serves to explain the principles of the invention. In the drawing.

Reference will now be made in detail to the presently preferred embodiments of the invention, examples of which are illustrated in the accompanying drawing.

DETAILED DESCRIPTION OF THE INVENTION

Set forth in greater detail below are specific details related to a device (e.g., a practice ball) and method for producing a collapsing-reforming ball for use in the practice of ball sports. The examples set forth herein are in no way intended to limit the scope of the invention. Those of skill in the art will realize that, given the teachings provided herein, many variations of the device and method are possible that will fall within the scope of the general concept of the teachings set forth herein for a collapsing-reforming ball.

The instant invention provides a collapsing-reforming ball that simulates the performance of a regulation size sport ball up to the point of being struck. In a presently preferred embodiment, the collapsing-reforming ball is formed of a suitable highly soft resilient rubberized material. The material may be selected from any of a group of materials of rubber like material that is soft and resilient, including, but not limited to, natural and synthetic elastomers, natural rubber, butadiene, butyl rubber, polybutyldiene rubber, styrene butyl diene, and the like.

Figure 1:
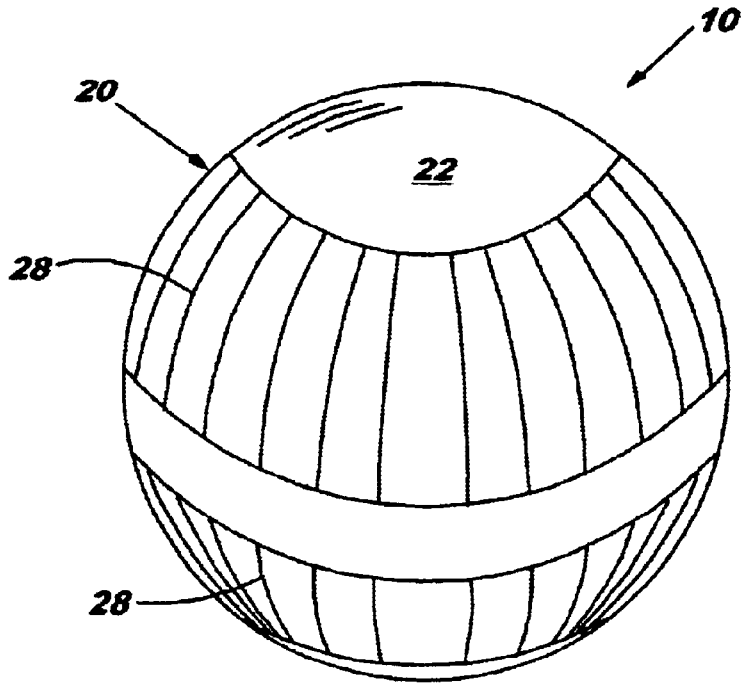
FIG. 1 is a perspective view of the ball of the present invention shown with the collapsing incisions in the resting position.
Figure 2:
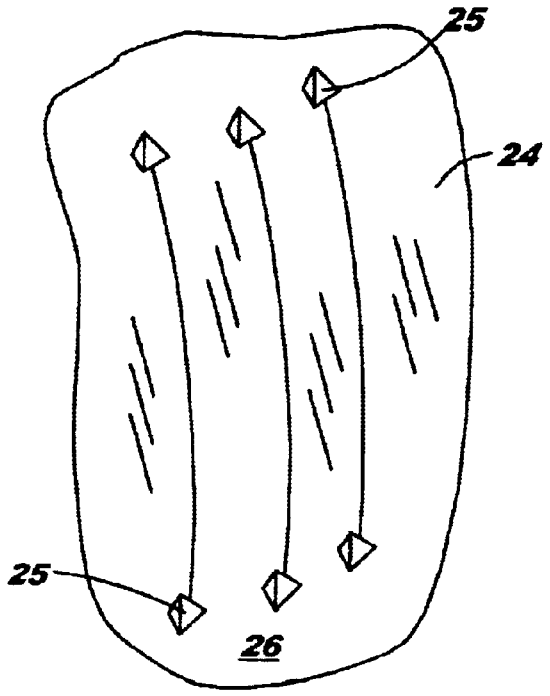
FIG. 2 is a closeup partial cross sectional view of the exterior shell of the ball of the present invention shown with the collapsing incisions in the resting position.

Referring now to FIGS. 1–2, in a preferred embodiment of the invention, the ball 10 of this invention comprises an exterior shell 20 having an outer surface 22 and an inner surface 24, which defines a hollow interior 26. Deformable or collapsing incisions 28 of varying shape and size are placed in the exterior shell 20, extending substantially through outer surface 22 and inner surface 24 of exterior shell 20. Optionally, thickened nodes 25 of material (FIG. 2) may be included adjacent to one or both ends of incisions 28. It will be appreciated that these nodes 25 may serve a dual purpose, i.e., to prevent inadvertent lengthening of incisions 28 or tearing of ball 10 along incisions 28 as a result of extended wear. The thickened nodes 25 may also, in accordance with their size and placement, contribute to the weight and flight characteristics of ball 10, allowing fabrication of a practice ball with flight characteristics simulative of an actual game ball.

The placement, position, length, shape, and number of the deformable or "collapsing" incisions 28 in outer shell 20 allow the collapsing-reforming ball 10 to collapse when an external force is applied, such as striking by a bat, club, foot or other item (not shown). The collapse absorbs the kinetic energy of the object striking the ball 10, thereby resulting in a shortened ball flight. The modulus of elasticity of the resilient outer shell 20 reforms the collapsed shell of the ball to its resting position after striking. It should be understood that the term "resting position" is meant to include the position or shape of the ball at rest or in flight after substantial recovery from the application of an external force. It should also be appreciated that should the ball inadvertently strike a user, the ball collapse results in a reduction of energy transfer from the ball to the user, significantly reducing the risk of injury.

It will be appreciated also that the number an shape of collapsing incisions 28, and the placement of these incisions on the outer surface 22 will be guided by the thickness and weight of the material comprising the outer shell 20 of the ball 10, and the degree of collapse desired for the ball 10 to dissipate a desirable amount of kinetic energy. For example, a number of linear incisions 28 may be placed in ball 10 as shown in FIG. 1. Alternatively, one or more incisions 28 as described above, each having a semicircular or "X" shaped conformation may be included in ball 10 to achieve the desired collapsing effect. It will further be appreciated that the thickness of exterior shell 20 may be varied to increase or decrease the collapsibility of the ball 10 as desired.

Figure 3:
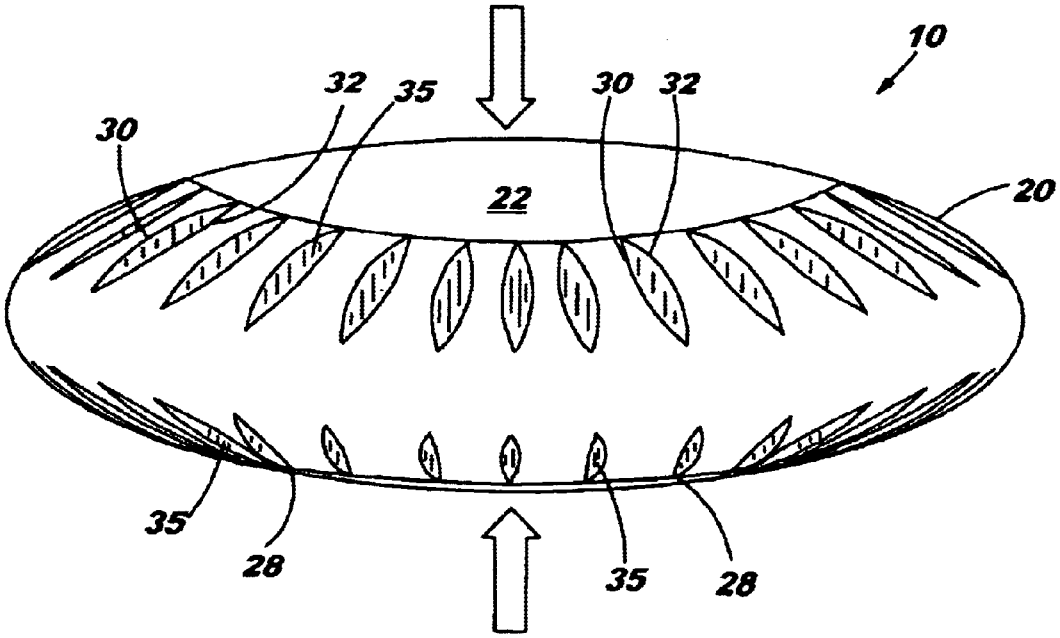
FIG. 3 is a perspective view of the ball of the present invention shown with the collapsing incisions in the collapsed position.

As best visualized in FIG. 3, each of the collapsible incisions 28 include a first side 30 and a second side 32. When the ball 10 is at rest or in flight after having been thrown, first side 30 and second side 32 are juxtaposed and in close apposition, presenting a substantially smooth surface with reduced aerodynamic drag (FIG. 1). Accordingly, when the ball is in flight after having been thrown, it behaves substantially as a normal ball would in flight.

Upon striking the ball 10 with an object, e.g., a bat, club or foot, first side 30 and second side 32 of incisions 28 separate, moving from the resting position to the collapsed position (as shown in FIG. 3). In one embodiment, movement of first side 30 and second side 32 to the collapsed position forms openings 35 (as shown, e.g., in FIG. 3) which is in fluid communication with the hollow interior cavity 26. Accordingly, the force applied to the ball 10 deforms and produces separation of the first side 30 and second side 32 of incisions 28 as the ball is urged from the resting position toward the collapsed position.

The force applied to the ball 10, in turn, may cause fluid (e.g., a gas such as air) contained within the hollow interior 26 of the ball 10 to vent or escape through openings 35 created by the collapsing ball 10. The escape of fluid (e.g., air) contained within hollow interior 26 in response to the force applied to exterior shell 20 and occurs as the ball 10 is deforming and absorbing the momentum of the force applied to the ball 10 thereby resulting in a shorter ball flight.

It will be appreciated that this separation of first side 30 and second side 32 of the collapsible incisions 28, along with causing the ball 10 to collapse, for a short time advantageously increases aerodynamic resistance of the ball 10 to the air through which it travels, further reducing the distance which the ball travels. Specifically, deformation of incisions 28 toward the collapsed position: (1) vents air contained within hollow interior 26 of ball 10; (2) absorbs the momentum applied to the ball 10; and (3) transiently exposes a portion of the hollow interior 26 to ambient air, thereby increasing wind resistance of the ball 10 in flight for a short period of time. The combination of these effects results in a shorter ball flight. As the ball 10 leaves the bat, club or foot, the modulus of elasticity of the resilient shell reforms the collapsed shell of the ball to its original shape or form (e.g., the resting position), ready for the next hit or kick.

Figure 4:
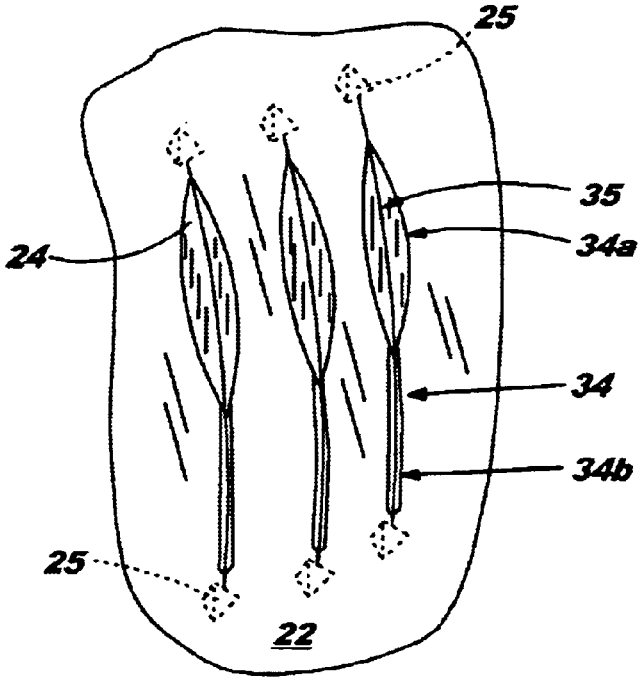
FIG. 4 is a closeup partial cross sectional view of the ball of the present invention in the collapsed position, shown with the collapsing incisions extending substantially through the outer and inner surface of the shell along a portion of their length, but extending substantially through the outer surface of the shell only along the remainder of their length.

One of skill in the art will appreciate that, as shown in FIG. 4, it is also possible to place additional incisions 34 in ball 10 whereby a first portion of the incision (34*a*) extends substantially through outer surface 22 and inner surface 24 of exterior shell 20, while the second portion of the incisions (34*b*) extends substantially through only outer surface 22 or inner surface 24 of exterior shell 20. Incisions placed on ball 10 in this manner further assist in causing ball 10 to collapse in response to a hit or kick, thereby absorbing momentum applied to the ball. It will also be appreciated that a combination of incisions 28 extending substantially through outer surface 22 and inner surface 24 of shell 20, plus separate incisions extending only through outer surface 22 or inner surface 24, will accomplish the same effect.

The collapsibility and flight characteristics of the ball are governed by the selection of materials used and its modulus of elasticity, variations in thickness at selected sites on the internal surface of the ball and location, length, number, shape, and axial position of collapsing incisions placed on the collapsing-reforming ball.

The collapsing incisions in the ball of this invention advantageously do not alter the performance of the ball in comparison to a regulation sport ball until the threshold of collapsibility is exceeded, e.g., the ball is struck. The absence of permanently open apertures in the shell of the collapsing-reforming ball allows the ball to maintain the normal feel, look and pre-impact flight characteristics of a regulation sport ball, until the threshold of collapsibility is exceeded by striking.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

What is claimed is:

1. A ball for simulating the performance of a regulation size sport ball, comprising:

a shell having an outer surface and an inner surface defining a fluid-filled interior; and at least one incision extending substantially through said outer surface and said inner surface of said shell, said incision having a first side and a second side;

wherein the first and second side of the incision are substantially juxtaposed in a substantially sealing engagement when the ball is in a resting position.

2. A ball as described in claim 1, wherein the fluid is a gas.

3. A ball as described in claim 1, wherein the ball, when struck in the resting position, resiliently moves from the resting position to a collapsed position such that the first side and the second side of the incision separate to form an opening in the shell which is in fluid communication with the fluid-filled interior.

4. A ball as described in claim 3, wherein movement from the resting position to the collapsed position resiliently deforms the ball thereby causing at least a portion of the fluid contained within the fluid-filled interior to pass through the opening in the shell.

5. A ball as described in claim 4, wherein the ball has a tendency to return to the resting position after being struck such that the first side and the second side of the incision return to substantial juxtaposition and a substantially sealing engagement.

6. A ball as described in claim 1, wherein the ball is fabricated from a material selected from the group consisting of natural and synthetic elastomers, natural rubber, butadiene, butyl rubber, polybutyldiene rubber, styrene butyl diene, and any mixture thereof.

* * * * *